US009325108B2

(12) United States Patent
Ivan

(10) Patent No.: US 9,325,108 B2
(45) Date of Patent: Apr. 26, 2016

(54) ELECTRICAL CONNECTOR ASSEMBLY FOR AN ELECTRONIC MODULE

(71) Applicant: GM Global Technology Operations LLC, Detroit, MI (US)

(72) Inventor: William T. Ivan, Shelby Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 149 days.

(21) Appl. No.: 13/875,881

(22) Filed: May 2, 2013

(65) Prior Publication Data

US 2014/0329401 A1 Nov. 6, 2014

(51) Int. Cl.

| | |
|---|---|
| ***H01R 13/40*** | (2006.01) |
| ***H01R 13/627*** | (2006.01) |
| ***H01R 43/26*** | (2006.01) |
| ***H01R 13/20*** | (2006.01) |
| ***H01R 13/42*** | (2006.01) |
| *H01R 11/12* | (2006.01) |

(52) U.S. Cl.

CPC ..... *H01R 13/627* (2013.01); *H01R 13/20* (2013.01); *H01R 13/42* (2013.01); *H01R 43/26* (2013.01); *H01R 11/12* (2013.01); *Y10T 29/49208* (2015.01)

(58) Field of Classification Search

CPC ..... H01R 13/40

USPC ..... 439/733.1, 595, 872

See application file for complete search history.

(56) References Cited

U.S. PATENT DOCUMENTS

| | | | | |
|---|---|---|---|---|
| 5,342,219 | A * | 8/1994 | Onodera | H01R 13/428 439/595 |
| 5,921,810 | A * | 7/1999 | Murakoshi | H01R 31/08 439/510 |
| 6,033,262 | A * | 3/2000 | Heimueller et al. | 439/595 |
| 6,178,106 | B1 * | 1/2001 | Umemoto | H01R 11/12 363/146 |
| 6,545,585 | B2 * | 4/2003 | Endo | H01H 85/0417 337/231 |
| 6,599,150 | B1 * | 7/2003 | Martin et al. | 439/595 |
| 7,001,214 | B2 * | 2/2006 | Fujii | 439/595 |
| 7,575,444 | B2 * | 8/2009 | Ikeda | H01M 2/1072 439/733.1 |
| 8,246,391 | B1 * | 8/2012 | Qu | H01R 13/428 439/733.1 |
| 2001/0028293 | A1 | 10/2001 | Endo et al. | |
| 2003/0220015 | A1 * | 11/2003 | Ishiyama | 439/595 |
| 2005/0197009 | A1 * | 9/2005 | Sasaki et al. | 439/595 |
| 2007/0015398 | A1 | 1/2007 | Ikeda et al. | |
| 2009/0093170 | A1 * | 4/2009 | Shinkawa | H01R 4/4809 439/733.1 |
| 2011/0014822 | A1 * | 1/2011 | Kato et al. | 439/733.1 |
| 2011/0151728 | A1 * | 6/2011 | Astola | 439/733.1 |
| 2013/0217262 | A1 * | 8/2013 | Ikeda | H01R 25/162 439/559 |

OTHER PUBLICATIONS

Chinese Office Action for CN Application No. 201410179801.9, dated Oct. 30, 2015, pp. 1-8.

* cited by examiner

*Primary Examiner* — Tho D Ta

(74) *Attorney, Agent, or Firm* — Cantor Colburn LLP

(57) ABSTRACT

An electrical connector assembly for an electronic module includes a plug element having a body including at least one terminal receiving section. The at least one terminal receiving section includes at least one locking tab element. At least one rigid bus bar terminal is mounted in the at least one terminal receiving section. The at least one bus bar terminal extends from a first end to a second end through a substantially rigid intermediate portion. The first end includes a locking tab member inter-engaging with the locking tab element and the second end includes a module connector member.

11 Claims, 3 Drawing Sheets

ELECTRICAL CONNECTOR ASSEMBLY FOR AN ELECTRONIC MODULE

FIELD OF THE INVENTION

The subject invention relates to the art of electrical connectors and, more particularly, to an electrical connector assembly for an electronic module.

BACKGROUND

Electronic modules are employed in a wide array of devices. Electronic modules may include processors, switches and the like which control various functions and/or communicate with other devices. Motor vehicles, for example, include a variety of control systems, many of which include control modules that are connected to various systems through a wire harness. Generally, the wire harness interfaces with the module through a connector. Presently, many connectors include a connector body that, in addition to being connected to the wire harness, includes multiple conductors that connect with the module. Each of the multiple conductors take the form of a braided wire including a first end having a first connector member and second end having a second connector member. The first connector member electrically interfaces with the one or more conductors in the wire harness through the connector body and the second connector interfaces with the module.

Typically, the first and second connectors are connected to the braided wire through crimp connections to establish a desired electrical connection. Occasionally, the crimp connections fail resulting in an electrical open. In addition, the braided wire, being flexible, often times does not maintain a desired position within the module, particularly when the second connector is being secured. When out of position, wires may be in too close of a proximity, resulting in cross-talk or allowing stray RF emissions to promulgate from the module, creating undesirable interference. Accordingly, it is desirable to provide a module connector with conductors that eliminate the need for crimp connections and also reduces cross-talk and undesirable RF emissions.

SUMMARY OF THE INVENTION

In accordance with an exemplary embodiment, an electrical connector assembly for an electronic module includes a plug element having a body including at least one terminal receiving section. The at least one terminal receiving section includes at least one locking tab element. At least one rigid bus bar terminal is mounted in the at least one terminal receiving section. The at least one rigid bus bar terminal extends from a first end to a second end through a substantially rigid intermediate portion. The first end includes a locking tab member inter-engaged with the locking tab element and the second end includes a module connector member.

In accordance with another exemplary embodiment, a method of connecting an electrical connector assembly to a module includes snap-fittingly inserting a first end of at least one rigid bus bar terminal into a terminal receiving section of a plug element, inserting the second end of the at least one rigid bus bar terminal into a module housing, and securing the second end of the at least one rigid bus bar terminal to an electrical connector in the module housing.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
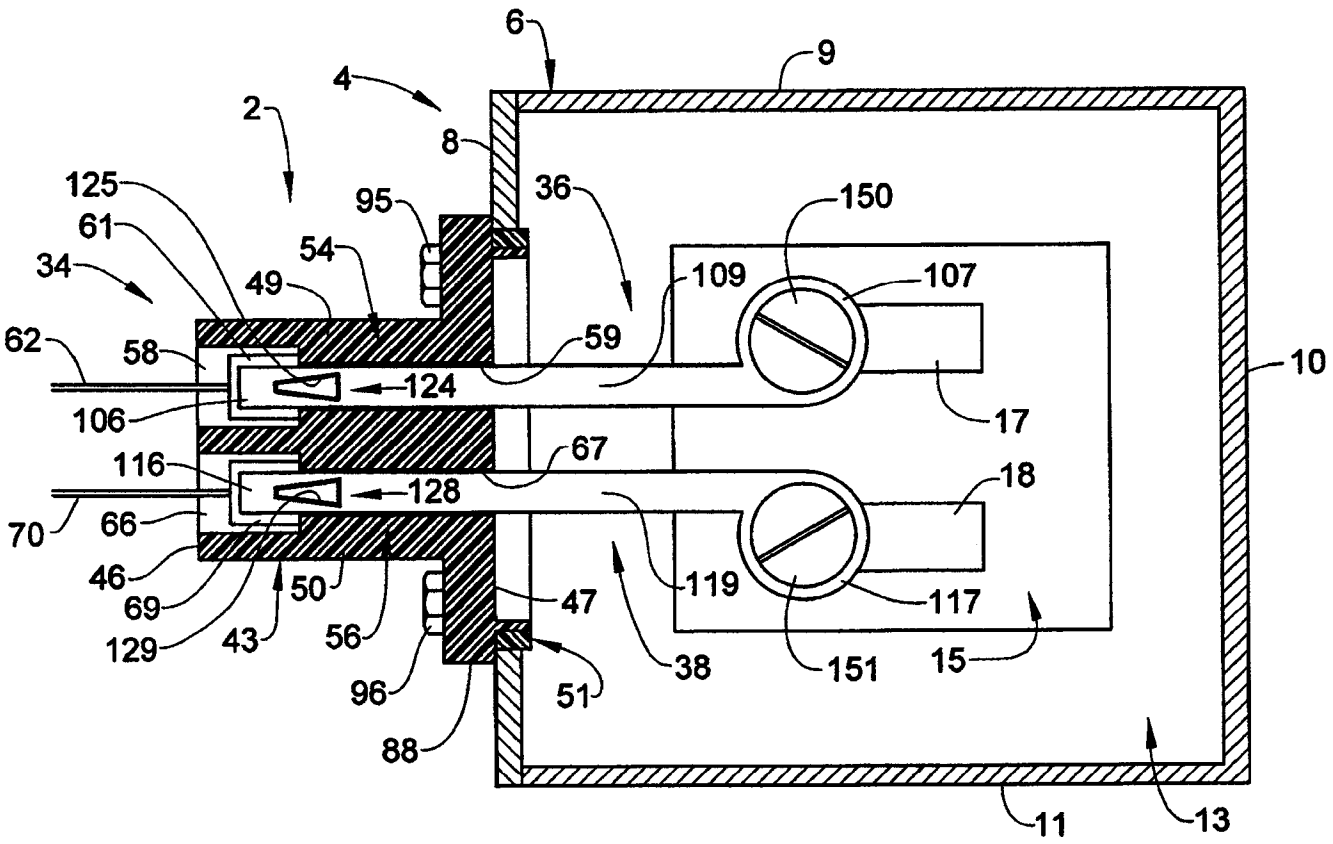
FIG. 1 is a cross-sectional plan view of a module coupled to an electrical connector assembly in accordance with an exemplary embodiment.
Figure 2:
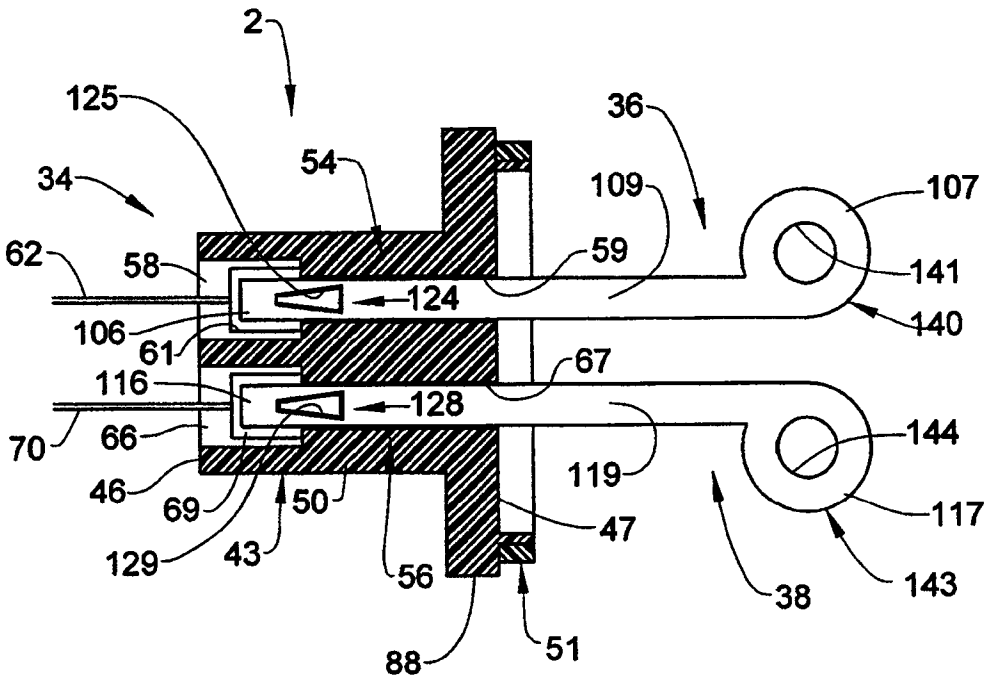
FIG. 2 is a cross-sectional plan view of the electrical connector assembly of FIG. 1.

The following description is merely exemplary in nature and is not intended to limit the present disclosure, its application or uses. It should be understood that throughout the drawings, corresponding reference numerals indicate like or corresponding parts and features. An electrical connector assembly, in accordance with an exemplary embodiment, is indicated generally at 2 in FIGS. 1 and 2. Electrical connector assembly 2 is shown joined to a module 4 having a housing 6 including a first wall 8, a second wall 9, a third wall 10, and a fourth wall 11 that collectively define, at least in part, an interior 13. An electronic component 15 having a first module terminal 17 and a second module terminal 18 is arranged within housing 6. In accordance with an exemplary embodiment, electronic component 15 is configured and disposed to control one or more systems of a motor vehicle. It should be understood that the exemplary embodiment is not limited to motor vehicle applications and may be used to connect with electronic modules employed in any number of installations.

In accordance with an exemplary embodiment, electrical connector assembly 2 includes a plug element 34, a first rigid bus bar terminal 36 and a second rigid bus bar terminal 38. Plug element 34 includes a body 43 extending from a first end portion 46 to a second end portion 47 through an intermediate portion 49. Plug element 34 includes a sealing member 51 provided at second end portion 47. Sealing member 51 provides a substantially water resistant seal between electrical connector assembly 2 and module 4. Plug element 34 also includes a first terminal receiving section 54 arranged within body 43 and a second terminal receiving section 56 arranged within body 43. Second terminal receiving section 56 is arranged adjacent to first terminal receiving section 54. First terminal receiving section 54 extends from a first end section 58 to a second end section 59. A first terminal member 61 is arranged at second end section 59. First terminal member 61 provides an electrical interface for a first conductor 62. Second terminal receiving section 56 extends from a first end section 66 to a second end section 67. A second terminal member 69 is arranged at second end section 67 of second terminal receiving section 56. Second terminal member 69 provides an electrical interface for a second conductor 70.

Figure 3:
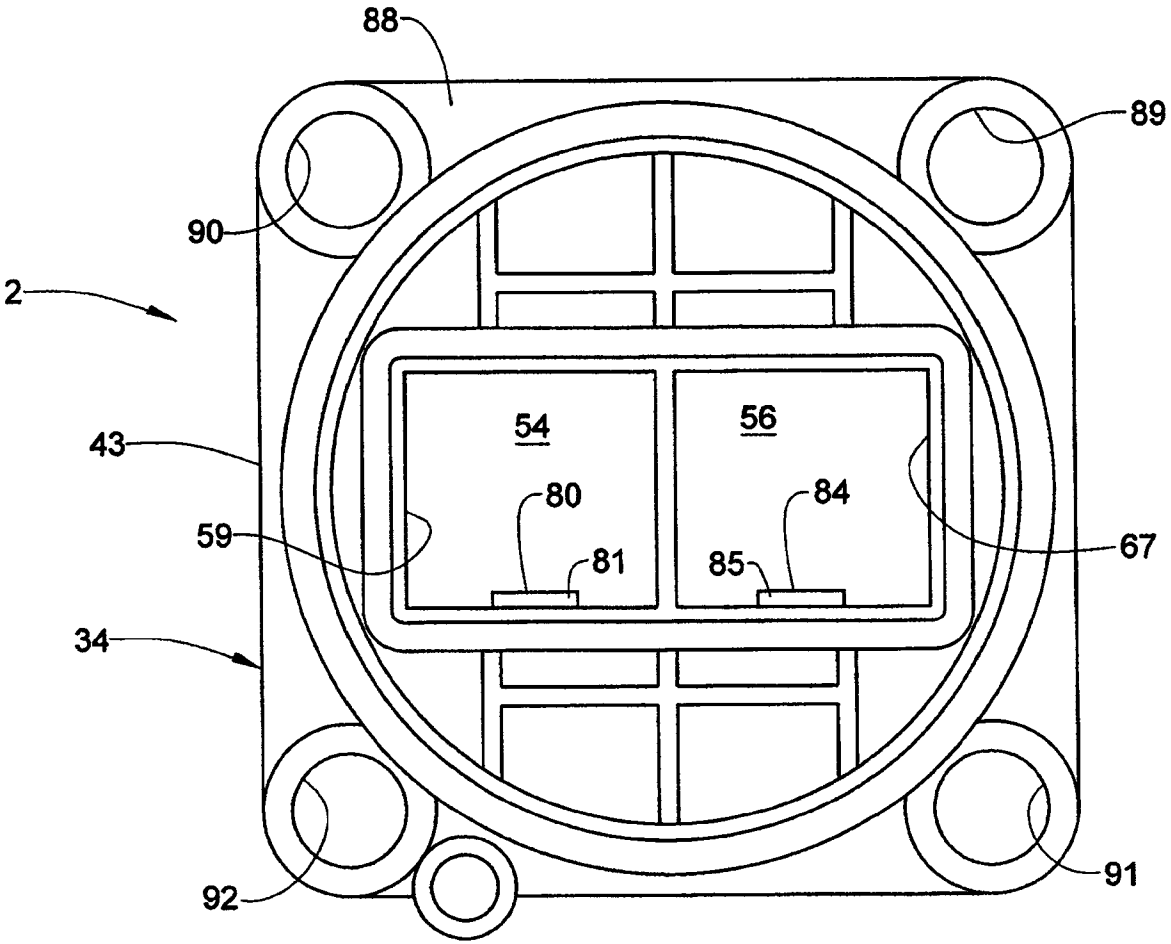
FIG. 3 is an axial end view of a plug element of the electrical connector assembly of FIG. 2.

As best shown in FIG. 3, a first locking tab element 80 extends into first terminal receiving section 54. First locking tab element 80 takes the form of a first projection 81 that, as will be detailed more fully below, retains first rigid bus bar terminal 36. A second locking tab element 84 extends into second terminal receiving section 56. Second locking tab element 84 takes the form of a second projection 85 that retains second rigid bus bar terminal 38. In addition, plug element 34 includes a peripheral flange 88 including first, second, third and fourth passages 89, 90, 91 and 92 that receive mechanical fasteners, two of which are indicated at 95 and 96 (FIG. 1), for securing electrical connector assembly 2 to module 4. It should be understood that other fastening systems including adhesives, friction connections, snap-fit connections and the like may also be employed to secure plug element 34 to an electronic module.

In further accordance with the exemplary embodiment, first rigid bus bar terminal 36 extends from a first end 106 to a second end 107 through a substantially rigid intermediate portion 109. Similarly, second rigid bus bar terminal 38 extends from a first end 116 to a second end 117 through a substantially rigid intermediate portion 119. First end 106 of first rigid bus bar terminal 34 includes a first locking tab member 124. First locking tab member 124 takes the form of an opening 125 that receives first locking tab element 80. First end 116 of second rigid bus bar terminal 38 includes a second locking tab member 128 that takes the form of an opening 129 that receives second locking tab element 84. Second end 107 of first rigid bus bar terminal 36 includes a first module connector member 140 that takes the form of a first ring connector 141. Similarly, second end 117 of second rigid bus bar terminal 38 includes a second module connector member 143 that takes the form of a second ring connector 144. At this point it should be understood that while shown and described as ring connectors, first and second module connector members 140 and 143 may take on a variety of forms including other types of solderless connectors such as spade connectors, and bayonet connectors, as well as soldered connectors.

First and second rigid bus bar terminals 36 and 38 are inserted into corresponding ones of first and second terminal receiving sections 54 and 56. Each first end 106 and 116 electrically connects with a corresponding one of first and second terminal members 61 and 69. In addition, first and second locking tab elements 80 and 84 inter-engage with corresponding ones of first and second locking tab members 124 and 128 to secure first and second rigid bus bar terminals 36 and 38 to plug element 34. Once in position, first and second rigid bus bar terminals 36 and 38 are spaced, one from the other, a desired fixed distance. The desired fixed distance, in accordance with one aspect of the exemplary embodiment, is constant. In accordance with another aspect of the exemplary embodiment, the desired fixed distance may vary. In this manner, when inserted into module 4, first and second rigid bus bar terminals 36 and 38 maintain the desired fixed distance to reduce cross-talk, RF interference and the like. First and second rigid bus bar terminals 36 and 38 are secured to corresponding ones of first and second module terminals 17 and 18 by mechanical fasteners 150 and 151 that extend through corresponding ones of first and second ring connectors 141 and 144.

At this point it should be understood that the exemplary embodiments provide an electrical connector assembly that includes rigid bus bar terminals that are resiliently retained within the plug element. In this manner, open circuits between the rigid bus bar terminal and associated conductors are avoided. In addition, the use of rigid bus bar terminals ensures that a desired spacing between terminals remains after installation. It should also be understood that the number and arrangement of rigid bus bar terminals may vary. In addition, it should be understood that the particular type and geometry of module connector members may vary.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. An electrical connector assembly for a motor vehicle comprising:

a plug element having a body including a first terminal receiving section including a first locking tab element defined by a first rigid projection and a second terminal receiving section including a second locking tab element defined by a second rigid projection;

a first rigid bus bar terminal mounted in the first terminal receiving section, the first rigid bus bar extending from a first end to a second end through a substantially rigid intermediate portion, the first end including a first locking tab member inter-engaging with the first locking tab element and the second end including a first module connector member; and a second rigid bus bar terminal extending from a first end to a second end through a substantially rigid intermediate portion, the first end including a second locking tab member inter-engaging with the second locking tab element and the second end including a second module connector member, wherein the first rigid bus bar terminal is spaced and electrically isolated from the second rigid bus bar terminal by a fixed distance.

2. The electrical connector assembly according to claim 1, wherein the at least one locking tab member comprises an opening formed in the at least one rigid bus bar terminal.

3. The electrical connector assembly according to claim 1, wherein the second end of the at least one rigid bus bar terminal constitutes a ring connector.

4. The electrical connector assembly according to claim 1, wherein the plug element includes a peripheral flange having at least one passage configured and disposed to receive a mechanical fastener for securing the module connector assembly to a module.

5. The electrical connector assembly according to claim 1, wherein the first rigid bus bar terminal is spaced and electrically isolated from the second rigid bus bar terminal by a fixed distance.

6. The electrical connector assembly according to claim 5, wherein the fixed distance is substantially constant from each of the first ends to each of the second ends.

7. A method of connecting an electrical connector assembly to an electronic module, the method comprising:

snap-fittingly inserting a first end of a first rigid bus bar terminal into a first terminal receiving section of a plug element;

inter-engaging a locking tab member on the first end of the first rigid bus bar terminal with a locking tab element defined by a rigid projection integrally formed on an internal surface of the first terminal receiving section;

inserting the a second end of the first rigid bus bar terminal into a housing; and securing the second end of the first rigid bus bar terminal to an electronic component in the housing;

snap-fittingly inserting a first end of a second rigid bus bar terminal, spaced and electrically isolated from the first rigid bus bar terminal into a second terminal receiving section of the plug element;

inter-engaging a locking tab member on the first end of the second rigid bus bar terminal with a locking tab element defined by a rigid projection integrally formed on an internal surface of the second terminal receiving section;

inserting a second end of the second rigid bus bar terminal into a housing; and securing the second end of the at least one rigid bus bar terminal to an electronic component in the housing.

8. The method of claim 7, wherein inter-engaging the locking tab member with the locking tab element includes establishing an electrical connection between the at least one rigid bus bar terminal and a terminal member provided in the terminal receiving section.

9. The method of claim 7, wherein securing the second end of the at least one rigid bus bar terminal to the electronic component in the module housing includes passing a mechanical fastener through an opening formed in the second end of the at least one rigid bus bar terminal.

10. The method of claim 7, wherein inserting the second ends of the first and second rigid bus bar terminals into the housing includes maintaining a desired fixed distance between the first and second rigid bus bar terminals.

11. The method of claim 10, wherein maintaining the desired fixed distance between the first and second rigid bus bar terminals includes maintaining a constant fixed distance between the first and second rigid bus bar terminals.

* * * * *